United States Patent [19]

Schutz

[11] Patent Number: 4,947,988

[45] Date of Patent: Aug. 14, 1990

[54] PALLET CONTAINER HAVING INNER CONTAINER SURROUNDED BY AN OUTER HOUSING OF LATTICE BARS

[76] Inventor: Udo Schutz, Ruckersteg 4, D-5418 Selters, Fed. Rep. of Germany

[21] Appl. No.: 296,126

[22] Filed: Jan. 12, 1989

[30] Foreign Application Priority Data

Jun. 11, 1988 [DE] Fed. Rep. of Germany ..... 3819911

[51] Int. Cl.[5] ..... B65D 19/00; B65D 90/20

[52] U.S. Cl. ..... 206/386; 220/18.1; 220/19; 220/84; 220/401; 222/105; 222/183

[58] Field of Search ..... 206/386; 108/55.1; 220/18.1, 70.1, 72.1, 401, 84, 19, 1.5; 222/105, 183

[56] References Cited

U.S. PATENT DOCUMENTS

| | | | |
|---|---|---|---|
| 3,084,966 | 4/1963 | Higgins | 220/19 X |
| 3,707,033 | 12/1972 | Knott | 220/19 X |
| 3,946,897 | 3/1976 | Wolff | 220/306 |
| 4,053,079 | 10/1977 | Karpisek | 220/19 X |
| 4,090,633 | 5/1978 | Trubiano | 220/1.5 X |
| 4,173,288 | 11/1979 | Schutz | 220/1.5 |
| 4,209,183 | 6/1980 | Jones et al. | 108/55.1 X |
| 4,676,373 | 6/1987 | Schneider | 206/386 |
| 4,795,057 | 1/1989 | Jungels et al. | 220/401 |

FOREIGN PATENT DOCUMENTS

| | | | |
|---|---|---|---|
| 0284290 | 9/1988 | European Pat. Off. | 206/386 |
| 2811655 | 9/1979 | Fed. Rep. of Germany | 220/19 |
| 3039635 | 10/1985 | Fed. Rep. of Germany . | |
| 2596360 | 10/1987 | France . | |

*Primary Examiner*—Bryon P. Gehman

*Attorney, Agent, or Firm*—Young & Thompson

[57] ABSTRACT

The pallet container is usable as a safely operating multiple-trip container. The outer shell (3) of the inner container (2) is constituted by vertical and horizontal lattice bars (4, 5) in close contact with the inner container (2) and forming continuous external boundary planes. The inner container (2) has a black coloring for its own protection, and for protection of the filling material against UV radiation, and is eqipped with an optical filling level indication in the form of a visible strip (52) with a filling level indicator scale (53). The pallet container (1) is usable as a safely operating multiple-trip container for liquid material of all kinds.

13 Claims, 5 Drawing Sheets

Figure 3:
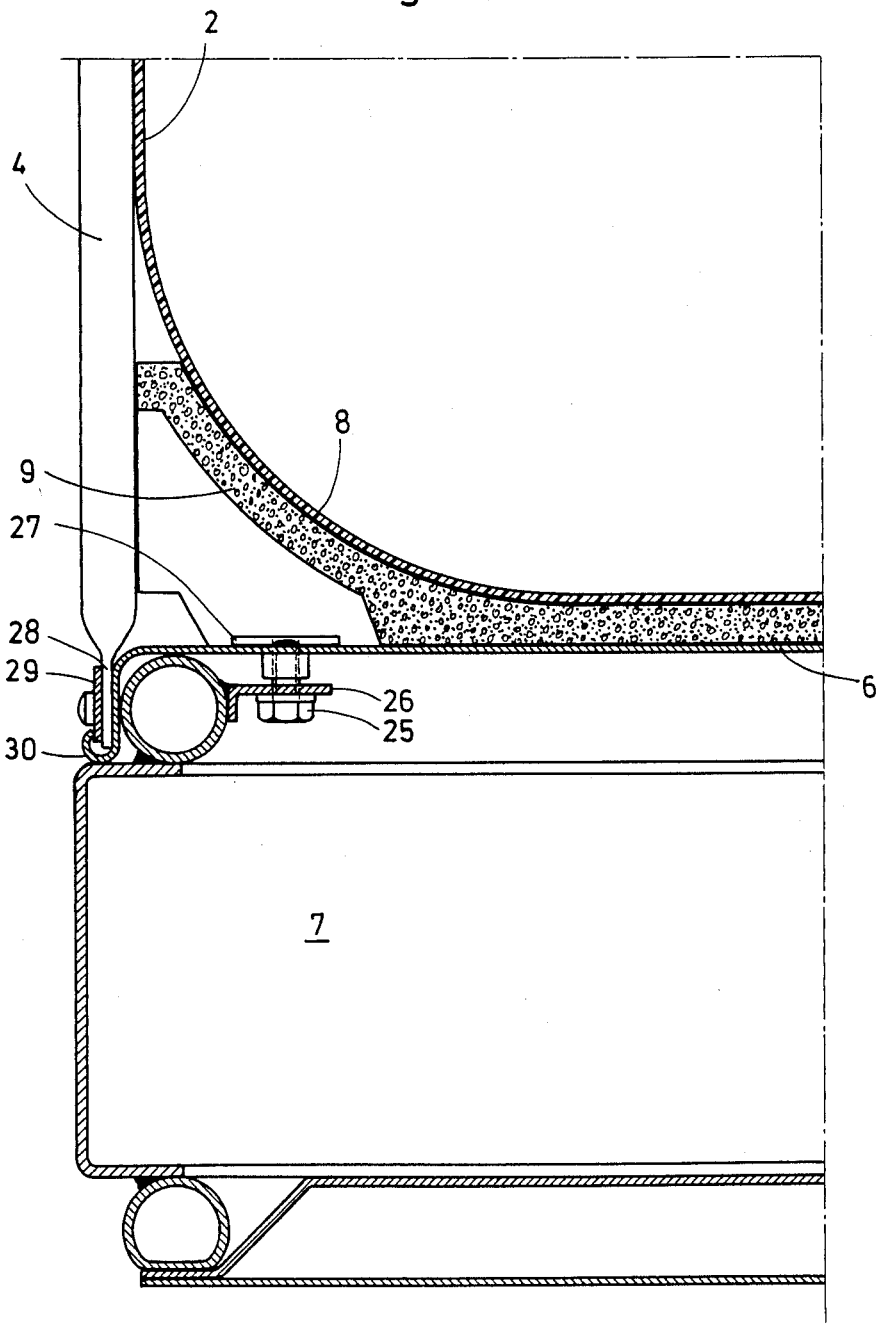

Fig. 1
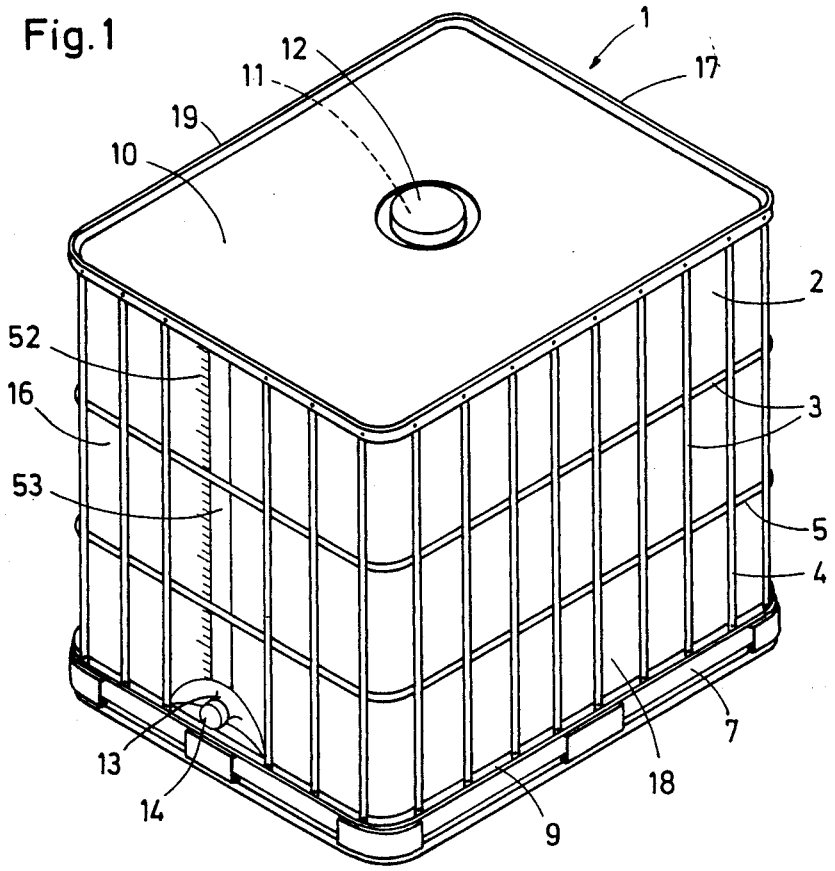
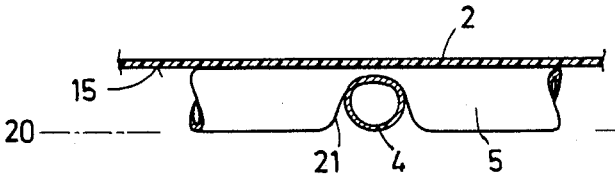
Fig. 2a
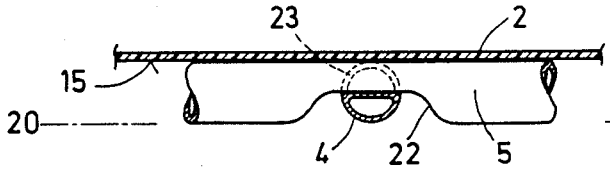
Fig. 2b
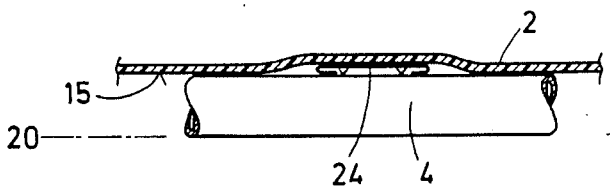
Fig. 2c

Fig. 7
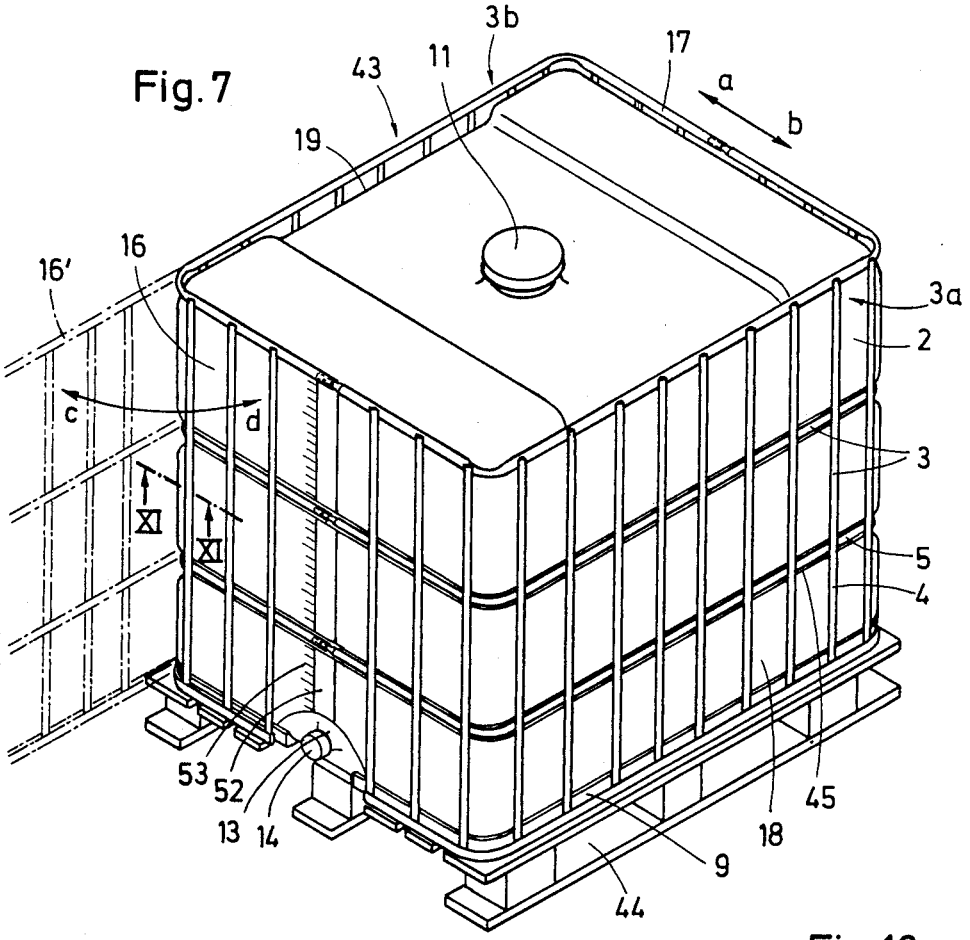
Fig. 10
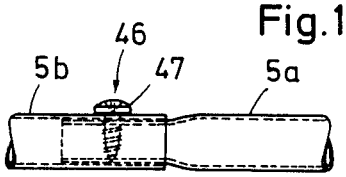
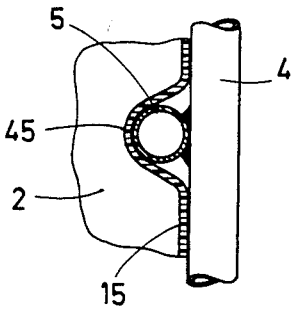
Fig. 9
Fig. 11
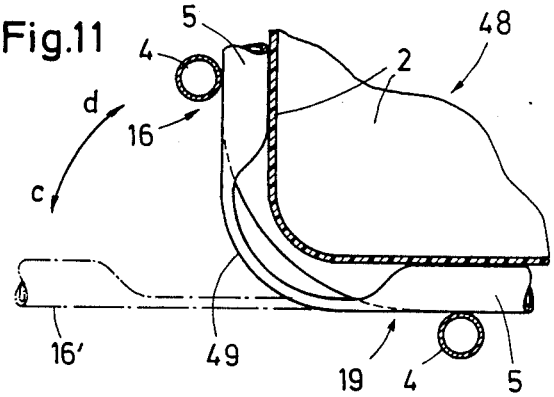

PALLET CONTAINER HAVING INNER CONTAINER SURROUNDED BY AN OUTER HOUSING OF LATTICE BARS

The invention relates to pallet containers with a flat pallet, an exchangeable inner container of a synthetic resin with an upper filling port and a lower discharge means, as well as an outer jacket surrounding the inner container and made up of a latticework with vertical and horizontal lattice bars.

Such pallet containers, known from German Patent No. 3,039,635 as well as U.S. Pat. No. 4,795,057 are utilized for the storage and transportation of liquid goods of all types of the chemical, pharmaceutical, mineral oil, and grocery industries. These pallet containers commercially available exhibit the drawback that, during transport, in case of a twisting of the loading surface of the conveyor, e.g. a truck traveling over a rise in the terrain or over unevennesses in the roadway, there is the danger that a pallet container climbs with its lattice jacket along the lattice jacket of the neighboring pallet container in the upward direction, and the pallet containers are thereby damaged. A further disadvantage of these conventional pallet containers is to be seen in that the synthetic resin material employed for manufacturing the inner container is not resistant against solar ultraviolet radiation. This deficiency has the result that when the pallet containers are stored for a relatively long time in the open air, the molecular structure of the synthetic resin is destroyed by the solar UV radiation and thereby embrittlement of the synthetic resin occurs; as a consequence, in case of an external impact or shock effect, the synthetic resin can spring a leak. This lack of stability of the synthetic resin material of the inner container against UV radiation practically excludes the usage of the pallet container as a multiple-trip container. Finally, the known pallet containers, on account of their permeability toward UV radiation, cannot be utilized for storage and transport of liquids that are sensitive to UV radiation.

The invention is based on the object of developing a safely operating multiple-trip pallet container for the storage and conveyance of liquids of all types.

This object has been attained, starting with a pallet container of the type described hereinabove, by the characterizing features described below.

The pallet container of this invention is distinguished by the following advantages:

During transport, "climbing" and thus mutual damaging of containers disposed side-by-side on account of a twisting of the loading surface is precluded. The possibilities of lifting a synthetic resin inner container with smooth outer walls off the lattice shell, optionally after detaching a lid or an upper rigidifying and securing frame, and of lifting an inner container with peripheral grooves in the outer walls for receiving the horizontal tubular lattice bars and a lattice shell divided halfway out of the lattice shell from above, after releasing the lattice half shells, as well as the lateral withdrawal possibility for the inner container out of the lattice shell in case of a pallet container having a pivotable end wall section of the lattice shell, open up the feasibility of utilizing the pallet container as a multiple-trip container since the inner container removed from the lattice shell can be cleansed simply and rapidly. The simple removal of the inner container from the lattice shell permits a simple exchanging of the inner container and reconditioning of an inner container that is no longer usable. The black coloration of the inner container of synthetic resin ensures effective protection of the container as well as the liquid filling against ultraviolet radiation. The optical filling level indication with a visible strip of a translucent or transparent synthetic resin material integrated into the black wall of the inner synthetic resin container, and with a filling level indicator scale applied to the outside wall of the container beside the visible strip permits simple and rapid control of the amount of liquid within the container. Finally, the pallet container is distinguished by great ruggedness, ready stackability, as well as a relatively low empty weight.

Figure 4:
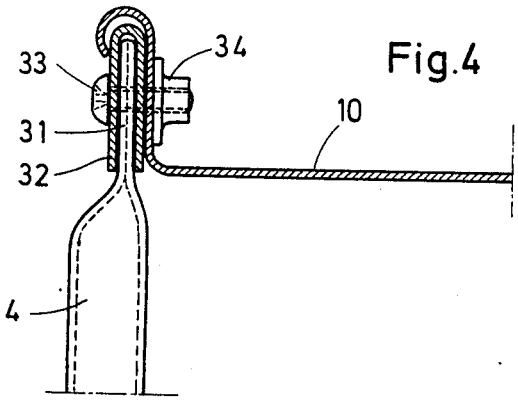
Figure 5:
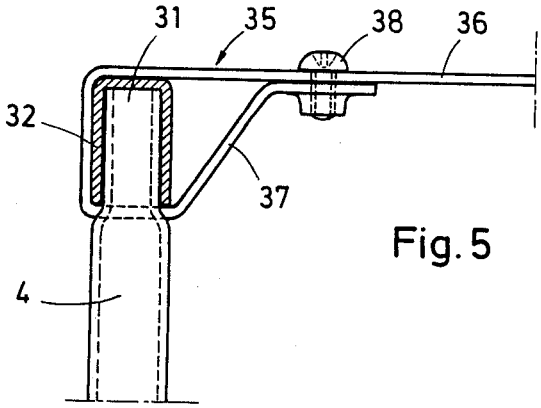
Figure 6:
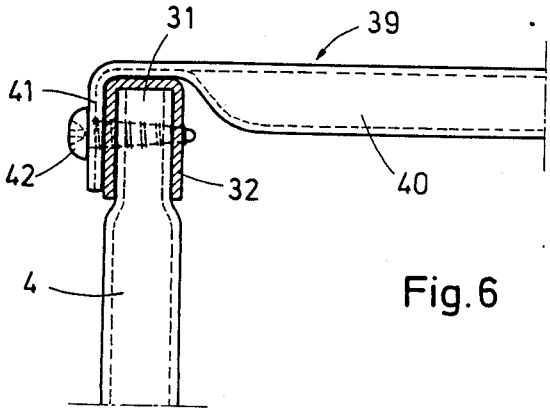
Figure 8:
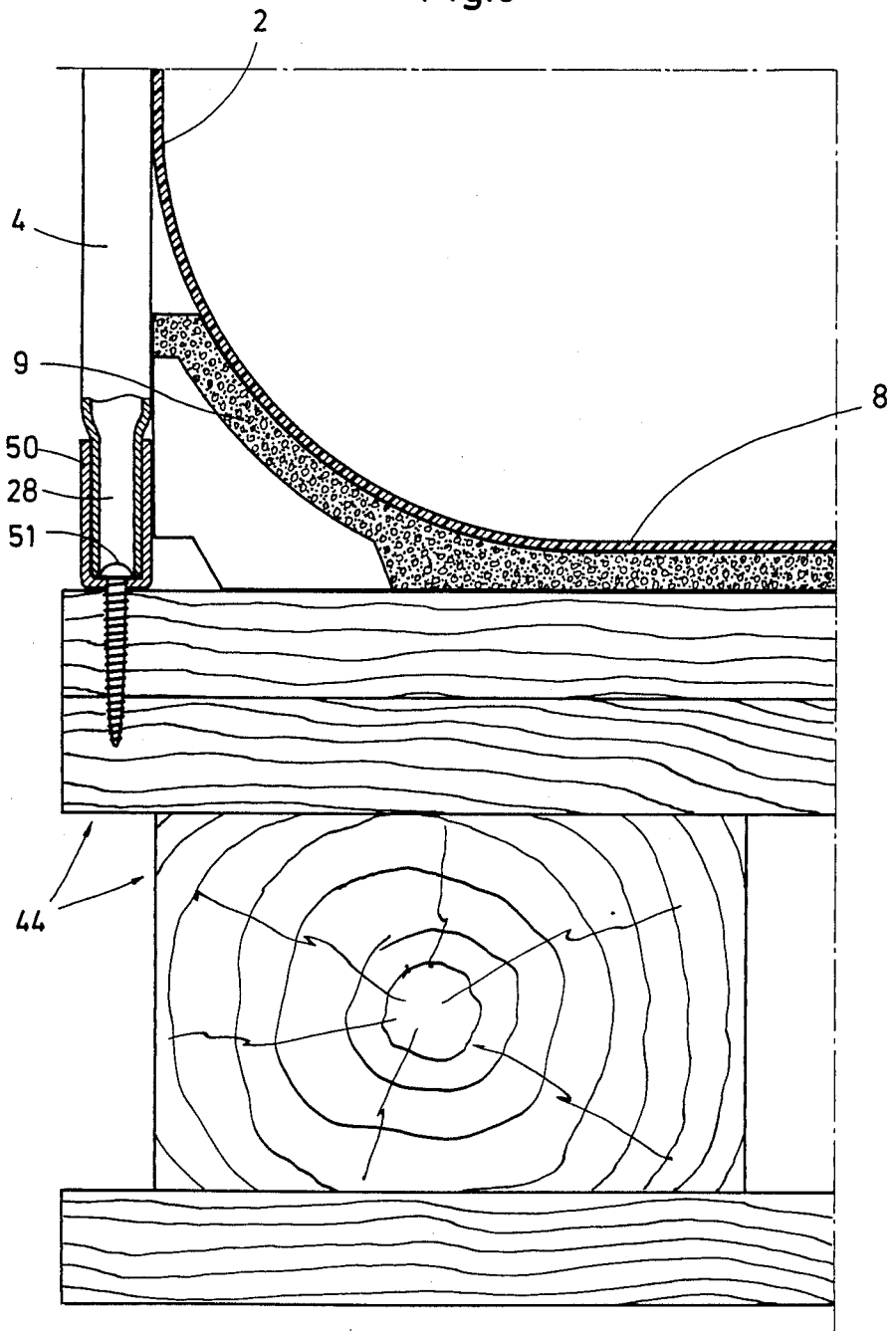

The invention will be described in greater detail below with reference to embodiments shown schematically in the drawings wherein:

FIG. 1 is a perspective view of a first embodiment of a pallet container with a steel pallet and a sheet-metal lid, FIGS. 2*a* and 2*b* show two embodiments of the cross connection of the lattice shell when using tubular lattice bars, FIG. 2*c* shows the cross connection of the lattice shell when using pipes as vertical lattice bars and strips as horizontal lattice bars, and in each case in enlarged detailed view, FIG. 3 shows the mounting of the vertical lattice bars and of the sheet-metal bottom to the steel pallet, FIG. 4 shows the attachment of the removable lid to the lattice shell, FIG. 5 shows the mounting of a locking and rigidifying frame of sheet-metal strip to the lattice shell, FIG. 6 shows the attachment of a locking and rigidifying frame made up of pipes to the lattice shell, FIG. 7 is a perspective view of a second embodiment of a pallet container with a divisible lattice shell, a wooden pallet, and a sheet-metal lid, and in each case on an enlarged scale, FIG. 8 shows the mounting of the vertical lattice bars to the wooden pallet, FIG. 9 shows the cross connection of the lattice shell of the pallet container according to FIG. 7, FIG. 10 shows the connection of the divided horizontal tubular lattice bars according to FIG. 7, and FIG. 11 shows a horizontal section through a corner zone, designed as a hinge, pertaining to a third embodiment of the pallet container, with a pivotable end wall section of the lattice shell along line XI—XI of FIG. 7.

The pallet container 1 according to FIG. 1 for the storage and transportation of liquid merchandise exhibits as the primary component an exchangeable inner container 2 having a rectangular basic contour and rounded corners, made of polyethylene, an outer shell 3 of intersecting vertical and horizontal lattice bars 4, 5 of metal, a sheet-metal bottom 6, a steel pallet 7, a support ring 9 of an elastically and plastically deformable material, such as, for example, polystyrene foam, arranged between the lower rounded rim 8 of the inner synthetic resin container 2, the lattice shell 3, and the pallet 7 and acting as a vibration damper, as well as a removable sheet-metal lid 10.

The inner container 2 has a filling port 11 in the center of its upper wall; this port can be sealed by means of a screw lid 12 or by means of a synthetic resin cam lid. At its lowermost point, the inner container 2 has an outlet port 13 which is likewise sealed by means of a screw cap 14 and additionally by means of a film laminated with a synthetic resin (not illustrated) so that after the cap 14 has been unscrewed an appropriate tap fitting, e.g. a pound-in faucet or screw-on faucet, can be attached.

The vertical and horizontal lattice bars 4, 5 of the lattice shell 3 are designed as tubular rods in intimate contact with the outer wall 15 of the inner container 2 made of a synthetic resin. The lattice shell 3 forms continuous outer boundary planes 20—20 in the two end wall sections 16, 17 and the two sidewall sections 18, 19 so that "climbing" of neighboring pallet containers on account of twisting of the loading surface during transporting of the containers, for example, with a truck, is precluded (FIGS. *2a–2c*).

In order to form the intersecting connection depicted in FIG. *2a* at the intersection points, the horizontal tubular lattice bars 5 of the lattice shell 3 accommodate the vertical lattice bars 4 in troughs 21, the depth of which corresponds to the outer diameter of the vertical tubular lattice bars 4.

In the cross connection according to FIG. *2b*, the assembled vertical and horizontal tubular lattice bars 4, 5 of the lattice shell 3 exhibit troughs 23, 22 having a depth corresponding approximately to half the outer diameter of the bars.

In the lattice shell design according to FIG. *2c*, the vertical lattice bars 4 are fashioned as tubular bars and the horizontal lattice bars are fashioned as sheet-metal strips 24.

The lattice bars 4, 5 and 4, 24 are welded together at the points of intersection.

The sheet-metal bottom 6 is attached to the steel pallet 7 by means of hexagon head screws 25, the latter in each case penetrating a mounting fishplate 26 at the steel pallet 7 and being threaded into a spot-welded nut 27 on the steel bottom 6. The lower, flattened ends 28 of the vertical tubular lattice bars 4 are joined together by means of a horizontal, flat strip 29 extending all around; these ends are placed onto the continuous rim 30 of the sheet-metal bottom 6, this rim being perpendicularly bent in the downward direction, and are threaded or welded to the sheet-metal bottom by means of the flat strip 29 (FIG. 3).

The upper, flattened and, respectively, drawn-in ends 31 of the vertical tubular lattice bars 4 of the lattice shell 3 are received by a continuously extending U-shaped profile member 32. The sheet-metal lid 10 is removably mounted at the U-shaped profile 32 by means of raised head cross-slotted screws 33, the latter passing through the U-shaped profile member 32 and the lattice bar ends 31 and being threaded into spot-welded nuts 34 at the sheet-metal lid 10 (FIG. 4).

The locking and rigidifying frame 35 of sheet-metal strip 36, shown in FIG. 5, is attached to the U-shaped profile 32 attached to the vertical tubular lattice bars 4 by means of holding brackets 37 integrally made with the frame, and by means of cross-slotted screws 38.

The locking and reinforcing frame 39 according to FIG. 6 consists of pipes 40, the ends of which are designed as mounting hooks 41. The frame 39 is placed with the hooks 41 onto the continuously extending U-shaped profile member 32 accommodating the reduced upper ends 31 of the vertical tubular lattice bars 4. In order to fasten the locking frame 39 to the lattice shell 3, the hooks 41 of the frame pipes 40 are threaded by means of self-cutting cross-slotted sheet-metal screws 42 to the U-shaped profile 32 and the upper ends 31 of the tubular lattice bars 4.

After releasing the sheet-metal lid 10 and, respectively, the locking and reinforcing frames 35, 39 from the lattice shell 3, the inner synthetic resin container 2 can be lifted in the upward direction out of the lattice shell 3 for purposes of cleaning or exchange.

In the pallet container 43 according to FIG. 7, open at the top and mounted on a wooden pallet 44, the vertical and horizontal tubular lattice bars 4, 5 of the lattice shell 3 are superimposed at the points of intersection and welded together at that location, and the horizontal tubular lattice bars 5 are inserted in corresponding, continuously extending grooves 45 in the outer wall 15 of the inner synthetic resin container 2 (FIG. 9).

In order to be able to lift the inner container 2 of the pallet container 43 out of the lattice shell 3 from above, and to insert same in the lattice shell, the lattice shell 3 can be separated into two halves *3a, 3b*. For this purpose, the continuously extending horizontal tubular lattice bars 5 are divided in the two end wall sections 16, 17 into two tubular sections *5a, 5b* which can be assembled and the assemblage connection 46 is secured against disassembly by means of a screw 47. In order to remove the inner container 2 from above out of the lattice shell 3, the two shell halves *3a, 3b*, after releasing the plug-in connections 46, are somewhat pulled apart in the direction of arrow a–b.

A third embodiment 48 of the pallet container illustrated schematically in FIG. 7 and in detail in FIG. 11 permits lateral removal and lateral insertion of the synthetic resin inner container 2, with continuously extending grooves 45 to accommodate the horizontal tubular lattice bars 5, out of and, respectively, into the lattice shell 3 by means of a pivotable design of the end wall section 16 of the lattice shell. The horizontal tubular lattice bars 5, bent by 90°, are flattened in one corner zone between the end wall section 16 and the sidewall section 19 of the lattice shell 3 in order to form flexible hinge strips 49, and are divided in the other corner zone between the end wall section 16 and the sidewall section 18 of the lattice shell 3 so that the end wall section 16 can be placed, by pivoting in the direction of arrow c-d, into the open position 16' and can be closed again.

The reduced lower ends 28 of the vertical tubular lattice bars 4 are seated in a continuously extending U-shaped profile member 50 subdivided into two end wall and two sidewall sections, attached by means of screws 51 to the wooden pallet 44 (FIG. 8).

As in case of the pallet container 1 according to FIG. 1, a sheet-metal lid 10 or a locking and reinforcing frame 35, 39 can be placed onto the lattice shell 3 of the upwardly open pallet containers 43 and 48 in accordance with FIGS. 7 and 11.

The inner container 2 of a synthetic resin for the various pallet container embodiments 1, 43, 48 has a black coloring for protection of the container and of the liquid material contained therein against UV radiation. An inexpensive and effective black coloring of the inner container 2 is achieved by adding carbon black to the synthetic resin, preferably polyethylene, used for manufacturing the container.

The inner container 2 of the various embodiments of pallet containers 1, 43, 48 is equipped with an optical filling level indication exhibiting a visible strip 52 of a translucent or transparent synthetic resin material resistant to UV radiation, arranged in one end wall section 16 or in both end wall sections 16, 17, this synthetic resin material constituting a homogeneous component with the black-dyed synthetic resin material of the container 2, as well as with a filling level indicator scale 53 arranged beside the visual strip 52 on the outer wall 15 of the container 2.

The outer surfaces of the jacket of the black-dyed synthetic resin inner container 2 are eminently suitable for merchandising purposes.

What is claimed is:

1. A pallet container with a flat pallet, an exchangeable inner container of a synthetic resin with an upper filling port and a lower discharge means, an outer housing secured to the pallet and surrounding the inner container, the outer housing comprising vertical and horizontal rigid metal lattice bars having inner surfaces in contact with an outer wall of said container, said housing comprising four vertical wall sections, said horizontal lattice bars being disposed on the inner side of said vertical lattice bars, and horizontal continuously extending grooves preformed in said inner container, said horizontal lattice bars being disposed in said preformed grooves and outer surfaces of said container between said grooves being in contact with said vertical lattice bars.

2. A pallet container as claimed in claim 1, in which said vertical and horizontal lattice bars are tubes.

3. A pallet container as claimed in claim 1, in which said inner container is opaquely black.

4. A pallet container according to claim 3, the inner container having a translucent vertical strip through which the level of the contents of the container is visible, and a scale extending along said translucent strip for measuring said level.

5. A pallet container as claimed in claim 1, in which said inner container is of synthetic resin to which carbon black has been added to color it black.

6. A pallet container with a flat pallet, an exchangeable inner container of a synthetic resin with an upper filing port and a lower discharge means, an outer housing secured to the pallet and surrounding the inner container, the outer housing comprising vertical and horizontal rigid metal lattice bars having inner surfaces in contact with an outer wall of said container, said housing comprising four vertical wall sections, said horizontal lattice bars being disposed between said inner container and said vertical lattice bars and being in the form of flat strips.

7. A pallet container as claimed in claim 6, in which said vertical lattice bars are tubes.

8. A pallet container as claimed in claim 6, in which said inner container is opaquely black.

9. A pallet container according to claim 8, the inner container having a translucent vertical strip through which the level of the contents of the container is visible, and a scale extending along said translucent strip for measuring said level.

10. A pallet container as claimed in claim 6, in which said inner container is of synthetic resin to which carbon black has been added to color it black.

11. A pallet container with a flat pallet, an exchangeable inner container of a synthetic resin with an upper filing port and a lower discharge means, an outer housing secured to the pallet and surrounding the inner container, the outer housing comprising vertical and horizontal rigid metal lattice bars having inner surfaces in contact with an outer wall of said container, said housing comprising four vertical wall sections, and means for releasably securing at least one said wall section of said housing for horizontal movement relative to at least one other said wall section, thereby to permit lateral opening of said housing to permit lateral removal therefrom of said inner container.

12. A pallet container as claimed in claim 11, in which said horizontal lattice bars are tubes and said means comprises means for releasably securing ends of said tubes within each other.

13. A pallet container as claimed in claim 11, in which said means comprises a hinged corner portion of said housing which permits horizontal swinging movement of at least one of said vertical wall sections relative to at least one other of said vertical wall sections.

* * * * *